United States Patent [19]

Savageau

[11] 3,991,443

[45] Nov. 16, 1976

[54] SLIVER SEPARATING MEANS

[75] Inventor: Richard J. Savageau, Seneca, S.C.

[73] Assignee: Platt Saco Lowell Corporation, Easley, S.C.

[22] Filed: June 23, 1975

[21] Appl. No.: 589,015

[52] U.S. Cl. ..... 19/159 A
[51] Int. Cl.[2] ..... B65H 54/76
[58] Field of Search ..... 19/159 R, 159 A, 157; 242/82

[56] References Cited

UNITED STATES PATENTS

| | | | |
|---|---|---|---|
| 3,381,342 | 5/1968 | Selby et al. | 19/159 A |
| 3,605,198 | 9/1971 | Mackie | 19/159 A |

FOREIGN PATENTS OR APPLICATIONS

| | | | |
|---|---|---|---|
| 1,471,923 | 1/1967 | France | 19/159 A |
| 1,015,240 | 12/1965 | United Kingdom | 19/159 A |

*Primary Examiner*—Dorsey Newton
*Attorney, Agent, or Firm*—Joseph H. Heard

[57] ABSTRACT

A freely-rotatable fluted roll compressively engages the sliver projecting upwardly from a sliver can as such can is doffed from a textile sliver coiling apparatus. The roll exerts compressive and snubbing forces upon the sliver strand extending between the sliver can and the coiler head of the apparatus, causing separation of such strand during and in response to the can changing movement of the can away from the coiler head. Also disclosed are a preferred design of, and a preferred mounting arrangement for a sliver-separating roll usable for the foregoing purpose.

13 Claims, 5 Drawing Figures

FIG. 3
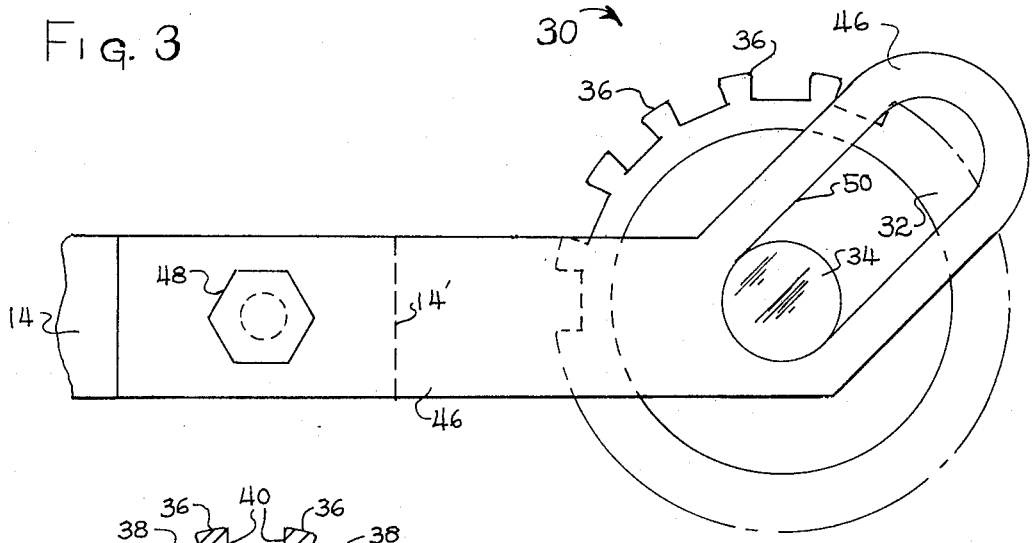
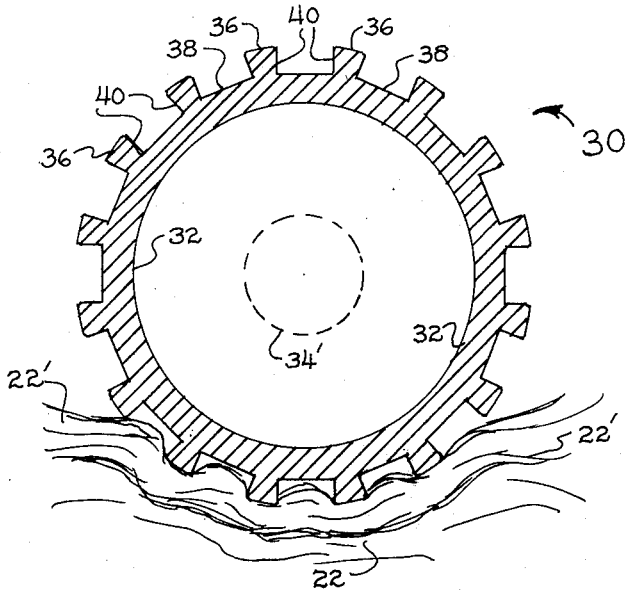
FIG. 4
FIG. 5
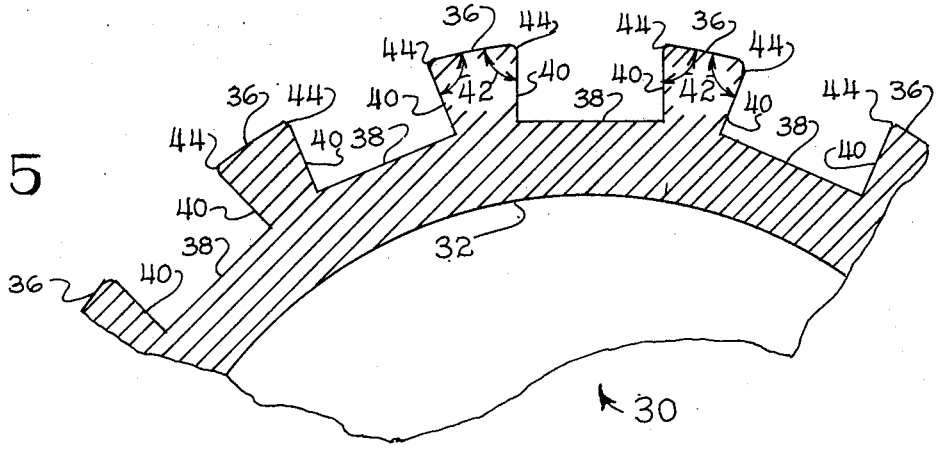

SLIVER SEPARATING MEANS

BACKGROUND OF THE INVENTION

This invention relates to textile sliver coiling apparatuses, particularly those equipped with automatic can changer mechanism, and more specifically relates to means for separating the sliver strand extending from the coiler head of such an apparatus to a sliver can which has been filled by the apparatus with sliver.

Numerous types of positively-driven knives, blades, rolls, combs, shears and the like have heretofore been proposed for cutting, severing, rupturing, or otherwise separating a sliver strand associated as aforesaid with a textile coiler. See, e.g., U.S. Pat. Nos. 3,605,198, 3,435,485, 3,381,342, 3,354,513, 3,353,224, 3,246,371, 3,083,416, 2,988,785, Re. 26,807, and British Pat. Nos. 1,172,811 and 929,507. Such positively-driven devices are necessarily complex in nature, and add significantly to the initial cost and the maintenance expense of the coilers with which they are associated.

More simplified sliver-separating techniques are disclosed in U.S. Pat. Nos. 3,249,968 and 3,382,543, and in British Pat. No. 370,081. In accordance therewith, a sliver filled can is moved beneath a member which is intended to securely clamp, against a sliver mass projecting upwardly from the sliver can, a terminal sliver strand extending therefrom. While such procedure is a highly desirable one from the viewpoint of simplicity, certain difficulties are inherent in its attempted utilization. If the force exerted by a clamping member upon the sliver is primarily merely frictional in nature, its magnitude must fall within relatively narrow limits. An excessive frictional force may degrade the sliver and/or disrupt its coiled arrangement within and above the sliver can. On the other hand, if the frictional force is too small, the desired clamping of the sliver strand against the underlying sliver mass will not ensue. Even when a clamping member so balances the foregoing variables as to perform satisfactorily in association with sliver of one given composition, such member frequently will not produce satisfactory results in association with other sliver of different composition. Thus, while the frictional force imposed by a relatively smooth clamping member might satisfactorily restrain a sliver comprised of cotton fiber, it might not do so if the sliver were comprised of snythetic fibers having a longer staple-length, a lesser coefficient of friction and/or a different crimp. Similarly, while the frictional force imposed by a sand-blasted or otherwise roughened surface might restrain and not degrade sliver comprised of synthetic fibers, cotton sliver might adhere thereto or be degraded thereby.

OBJECTS OF THE INVENTION

A primary object of the invention is the provision, in association with textile coiling apparatus having can changer means which moves a sliver filled can away from the coiler head of the apparatus during changing thereof, of highly economical and durable means for reliably causing, in response to such movement of the can, separation of the sliver strand extending between the can and the coiler head of the apparatus, while at the same time not degrading the sliver or significantly disrupting the coiled arrangement thereof within the sliver can, irrespective of the particular composition of the sliver.

A related object of the invention is the provision of a freely-rotatable sliver-snubbing roll for securing a sliver strand against a moving mass of coiled sliver underlying and connected to such strand and projecting upwardly from a sliver can moved beneath such roll, which roll has a deeply fluted but otherwise smooth-surfaced configuration which reliably produces a desired snubbing-type of restraining action upon the strand but which does not degrade the sliver or disrupt the coiled array thereof within the sliver can.

A more specific object is the provision of a fluted sliver-separating roll, of the aforesaid type, wherein the flutes define a plurality of alternating lands and valleys and interconnecting slopes so constructed that the angles defined between each of the lands and adjacent ones of the slopes is not more than approximately ninety degrees and preferably is an acute angle, and wherein at the roll periphery the ratio of the area of the lands to the spaces therebetween is no more than approximately one to one and preferably is approximately one to two or less.

Still another related and more specific object is the provision, in association with textile coiling apparatus of the described type, of mounting means which mounts a sliver-separating roll for free rotation about its axis in response to can changing movement of a sliver filled can therebeneath, and which also mounts such roll for movement from a normally lowered position to an elevated position when required to prevent possible accidental injury to an operator or damage to equipment.

SUMMARY OF THE INVENTION

The present invention provides a freely-rotatable and deeply-fluted roll adapted to compressingly engage the terminal strand and underlying coiled mass of sliver carried by and extending upwardly from a sliver filled can moved beneath the roll. The roll imposes compressive and snubbing forces which so constrain the aforesaid sliver strand as to cause its separation or parting in response to movement of the sliver can, while at the same time not degrading the sliver or disrupting the coiled array thereof within the can. In a preferred embodiment of the invention hereinafter described, the roll is mounted in association with a textile sliver coiling apparatus having can changing means for moving a full sliver can away from the coiler head of the apparatus along a predetermined path of travel. The fluted roll is mounted above the aforesaid can path of travel for engagement with the mass of sliver extending upwardly from said can and the strand of sliver extending therefrom to the coiler head of the coiling apparatus. The aforesaid engagement so constrains the sliver strand that, in response to the can's continued movement away from the coiler head, the strand is attenuated and separated intermediate its length. The sliver-engaging roll is preferably mounted in closely spaced, adjacent relationship to the coiler plate of the coiling apparatus for not only free rotation about its axis, but also for translatory movement between a normally lowered operating position wherein it projects below the undersurface plane of such coiler plate, and an elevated position wherein it is disposed entirely above the undersurface plane of the coiler plate of the apparatus. The roll normally remains in its lowered position, but moves freely to its elevated position when required to prevent operator injury and/or equipment damage.

DESCRIPTION OF THE DRAWINGS

Still other features and benefits of the invention will be apparent from the following description of a preferred embodiment thereof, which should be read in conjunction with the accompanying drawings, in which:

FIG. 3 is an enlarged fragmentary side elevational view, taken substantially in the direction of the arrows 3—3 of FIG. 2, of one end of the sliver separating roll shown in FIGS. 1 and 2, and of one of the bracket members supporting such roll;

FIG. 4 is a vertical cross-section through the sliver separating roll, and also shows in schematic form a sliver strand engaged thereby; and FIG. 5 is an enlarged fragmentary vertical cross-section through the sliver separating roll.

DESCRIPTION OF THE PREFERRED EMBODIMENT

Figure 1:
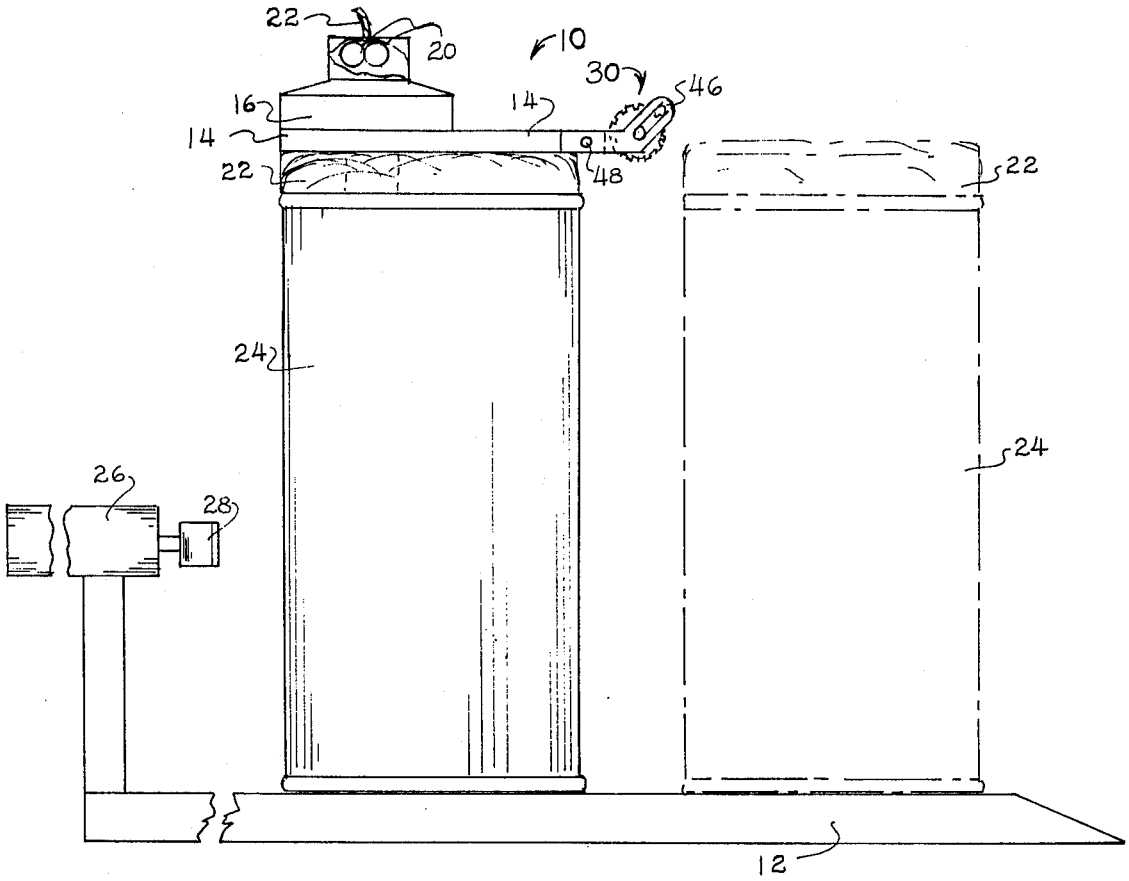
FIG. 1 is a partially-schematic and partially broken-away side elevation view of a textile sliver coiling apparatus equipped with automatic can changing means and with sliver separating means in accordance with the invention.
Figure 2:
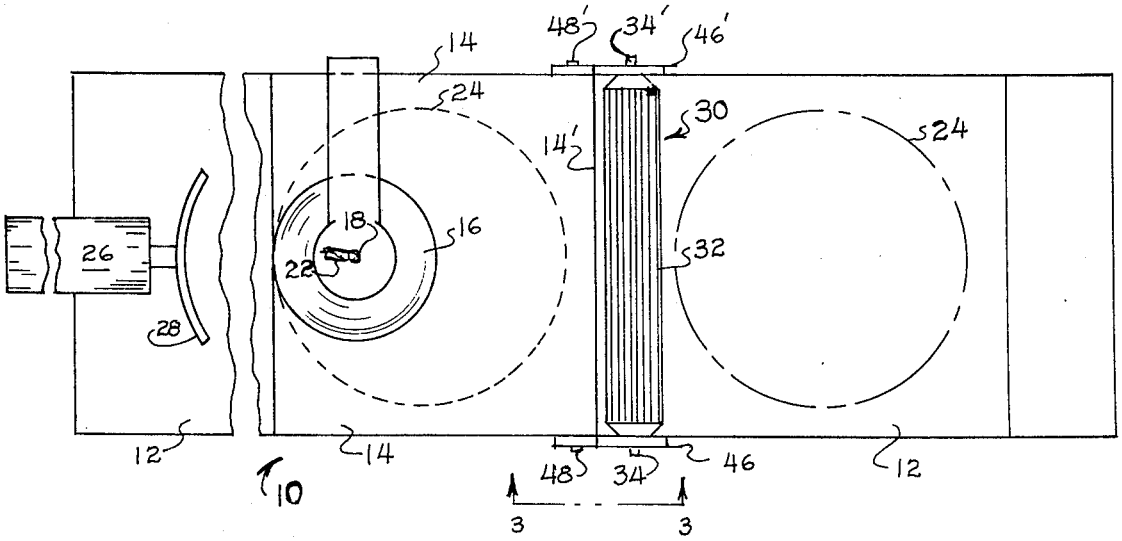
FIG. 2 is a top plan view of the apparatus of FIG. 1.

In FIGS. 1 and 2 of the drawings, the numeral 10 designates in its entirety a textile sliver coiling apparatus. The frame of apparatus 10 includes an elongate base structure 12 and a coiler plate 14 extending generally horizontally in vertically spaced relationship to each other. Carried by coiler plate 14 is a coiler head 16 which includes a trumpet 18 (FIG. 2), feed rolls 20 (FIG. 1), and a coiler tube assembly (not shown) rotatable about a vertical axis and having its undersurface substantially coplanar with the undersurface of coiler plate 14. During normal operation of apparatus 10, the feed rolls 20 and tube assembly (not shown) of coiler head 16 are driven so as to deliver textile sliver 22, which is introduced into the coiler head through trumpet 18, into a sliver can 24 supported upon base 12 of apparatus 10 beneath coiler head 16 and coiler plate 14. Base 12 may and normally will include a rotatable and/or otherwise movable turntable (not shown) for imparting rotative and/or other desired movement to the can 24 supported thereby as sliver 22 is delivered into such can from coiler head 16.

Sliver can 24 may have either a plain lower end or have casters thereat, and may have either a stationary or a vertically-movable "piston" bottom. If can 24 is of the piston-bottom type, then the sliver 22 introduced therein will project upwardly therefrom into engagement with the substantially smooth undersurfaces of coiler plate 14 and the tube assembly (not shown) of coiler head 16 during most of the can-filling operation, as well as at the completion of such operation. If sliver can 24 is of a stationary-bottom type, the sliver 22 delivered into such can will still project upwardly therefrom into pressing engagement with the undersurfaces of coiler plate 14 and the tube assembly (not shown) of coiler head 16 at the completion of the filling operation. In any event, therefore, once can 24 has been filled, the coiled mass of sliver 22 therein will project upwardly therefrom, as shown in solid lines in FIG. 1 and due to the inherent resiliency of the sliver and/or to the biasing effect of a piston-bottom can, into engagement with the undersurfaces of coiler plate 14 and the tube assembly of coiler head 16. And when the sliver 22 within can 24 is unrestrained, as shown in phantom lines in FIG. 1, it will project upwardly to an even greater extent.

When can 24 has been filled with sliver 22, this condition is detected by a suitable yardage-counter or other device (not shown) conventionally associated with apparatus 10. Suitable controls (not shown) then stop the normal operation of apparatus 10, including the rotation of the feed-roll and tube-assembly components of coiler head 16, and actuate can changer means which moves the full sliver can 24, along a predetermined path of travel, away from its prior position (shown in solid lines in FIG. 1) beneath coiler head 16. As schematically shown in FIGS. 1 and 2, the aforesaid changer means may comprise a fluid-actuated piston-and-cylinder assembly 26 mounted adjacent one end of base 12 of apparatus 10 (the left end as shown in the drawings), and having an arcuate pusher member 28 upon a pusher rod component. Upon actuation of assembly 26, pusher member 28 engages can 24 and moves the same longitudinally of base 12 and toward the opposite end (illustratively right-hand) thereof, from the full-line and to the phantom-line can position shown in FIGS. 1 and 2. After or concurrently with the moving or full sliver can 24, another empty sliver can (not shown) is positioned beneath coiler head 16 for filling thereby upon the resumption of normal operation of apparatus 10. Positioning of the empty can might of course be done manually by a machine operator, but normally would be accomplished by the can changer means associated with apparatus 10. It will be appreciated, in the foregoing regards, that the particular coiler apparatus 10 and can changer means 26 schematically shown in FIGS. 1 and 2 are merely illustrative of many well-known types familiar to those skilled in the art, and no restriction to any one type is intended or should be made. It should also be understood that the sliver coiling apparatus normally would be associated with some type of related textile equipment, such as a draw-box, card, comber, etc.

The present invention provides improved means for causing the separation of the terminal strand of sliver (not shown in FIGS. 1 and 2) extending upon cessation of normal operation of apparatus 10 between coiler head 16 and the upper surface of the mass of sliver within can 24 during and in response to the aforesaid movement of sliver can 24 from beneath coiler head 16. Such sliver-separating means includes a deeply fluted roll 30, preferably formed of aluminum or other metallic material, which is mounted upon the frame of apparatus 10 in closely overlying, transversly extending relationship to the path of travel followed by sliver can 24 during its movement away from coiler head 16.

Referring now also to the remaining figures of the drawings, as well as to FIGS. 1 and 2, roll 30 comprises a generally cylindrical main body 32 having a length at least equal to the diameter of sliver can 24, and having an outer diameter within the range of approximately one and one-half to four inches (3.81 – 10.16 centimeters) and preferably of approximately two inches (5.08 centimeters). Gudgeons 34, 34′ are fixedly secured to opposite ends of main body 32 of roll 30, and project axially therefrom. Sliver-snubbing means, in the form of relatively deep fluting, is provided upon and about the entire circumference of main body 32 of roll 30. Such fluting extends parallel to the axis and throughout the length of main body 32 of roll 30, and defines, as best shown in FIGS. 3–5, a plurality of alternating lands 36 and valleys 38 interconnected by slopes 40. The foregoing and all other surfaces of roll 30 are substantially smooth. The ratio of the area of lands 36 to the projected area of the spaces therebetween is no more than approximately one to one, and preferably is approximately one to two (as shown) or less. The included angle 42 (FIG. 5) defined between each land 36 and each slope 40 adjacent thereto is no more than approximately ninety degrees, and is preferably an acute angle: as shown in FIG. 5, each angle 42 has a magnitude of approximately seventy-eight degrees. Lands 36 all lie upon the circumference of an imaginary circle concentric with the central axis of roll 30, and each land 36 therefore has an arcuate or flat surface configuration in the width direction thereof. The edges 44 define by the intersection of each land 36 and an adjacent slope 40 have a small radius of curvature, preferably within the range of approximately 0.005 to 0.02 inches (0.127 to 0.508 millimeters), just sufficient to "blunt" the same and prevent the cutting of textile fibers or the hands of an operator coming into engagement therewith. As previously noted, the depth of each valley 38, that is the radial distance between each such valley and the circumference of the imaginary circle upon which lie lands 36, is of relatively great magnitude. When the outer diameter of roll body 32 is approximately 2 inches, such depth is preferably at least 0.10 inch (2.54 millimeters).

Referring now primarily to FIGS. 1–3, roll 30 is mounted upon the frame of apparatus 10 by a pair of bracket members 46, 46′ respectively secured in any suitable manner, as by means of bolts 48, 48′, adjacent opposite ends of that edge 14′ (FIG. 2) of coiler plate 14 beneath which sliver can 24 passes during its movement away from coiler head 16. While not necessarily so, bracket members 46, 46′ may be and illustratively are of identical construction. As shown in FIGS. 1 and 3 in the case of one of the brackets 46, 46′, a portion thereof and a slot 50 provided therein extend laterally upwardly and away from (i.e., to the right as viewed in the drawings) and adjacent terminal edge 14′ of coiler plate 14 of apparatus 10. Gudgeons 34, 34′ of roll 30 are respectively received within slots 50 of brackets 46, 46′, and are freely rotatably within and movable longitudinally of such slots. Although slots 50 and gudgeons 34, 34′ are shown as extending completely through the respective brackets 46, 46′, they may be formed so as to extend only partially through the brackets, if desired. In any event, when gudgeons 34, 34′ are within the upper ends of slots 50, roll 30 is disposed entirely above the generally horizontally extending plane of the undersurface of coiler plate 14 of apparatus 10. However, due to the considerable weight of roll 30, gudgeons 34, 34′ normally rest within the lower ends of slots 50, as shown in the drawings. At such time, the central axis of roll 30 still lies above the generally horizontally extending plane of the undersurface of coiler plate 14. However, the periphery of the main body 32 of roll 30 projects considerably below the undersurface plane of coiler plate 14, toward and above plane of the top surface of sliver can 24. The extent of such projection of roll body 32 beneath the plane of coiler plate 14 is preferably at least by an amount equal to approximately one-fourth of the diameter of the roll body. At the same time, in a lateral direction, the periphery of main body 32 of roll 30 is in a spaced, adjacent relationship to the terminal edge 14′ of coiler plate 14. A lateral spacing of within the range of approximately 0.375 – 0.5 inches (9.525 – 12.7 millimeters) is preferred, in the foregoing regard.

OPERATION OF THE INVENTION

During displacement by assembly 25 of a sliver filled can 24 from its full-line position and to its phantom line position shown in FIG. 1, the upper surface of the mass of sliver 22 contained within and projecting resiliently from the top of can 24 is compressively engaged by the downwardly projecting peripheral portion of roll 30 as can 24 moves beneath such roll. During and in response to the aforesaid engagement and movement, roll 30 rotates freely about its axis, in a counterclockwise direction as viewed in FIGS. 1 and 3 to 5, at a peripheral speed substantially equal to that of the rate of movement of sliver can 24. Such rotation of roll 30, in conjunction with the previously-noted smooth nature of the surfaces upon its main body portion 32, prevents the roll from abrading or in any other way degrading the engaged sliver 22, and from significantly disrupting its coiled arrangement within and above can 24. The size of roll 30 and its positioning relative to coiler plate 14, in both the lateral and vertical directions previously indicated, contribute to realization of the aforesaid desired results.

With a roll 30 of appropriate diameter and depth of flutings (36, 38, 40), and appropriate ratio of width of the lands to spaces therebetween, angle at edges 44 of the lands 36 and walls 40, distance of projection of the roll below the level of the spectacle or coiler plate 14 and distance spaced therefrom, as the sliver can 24 is moved out from under plate 14 the sliver now uncompressed by such plate will expand or bloom upwardly. In further travel of the can 24, the leading expanded portion of sliver 22 will encounter roll 30 at a portion of the non-horizontal side of said roll. In continued movement of can 24, the leading and moving portion of sliver 22 will rotate roll 30 and be compressed by it. In such compression, the sliver, formed of strands of loosely associated and slightly intertwisted staple fibers, will bloom or expand into the spaces between the lands, and be compressed at the land surfaces. With such blooming into the spaces between the lands and compression at the land surfaces, the edges defining the lands and adjacent inwardly projecting walls form snubbing grips on the sliver 22 causing the roll to rotatively move with longitudinal movement of the can 24 and sliver 22, providing no relative movement between the edges 44 and the sliver 22 gripped thereby, so long as such edges 44 are in contact with sliver 22; however, since roll 30 is rotating, one may think of such snubbing grip as a rolling nip of roll 30 across the surface of sliver 22 which would attenuate and cause parting of the terminal portion 22′ of sliver 22.

If the diameter of roll 30 were insufficient there would not be sufficient land surface area in contact with sliver 22 and area between lands into which sliver could bloom to avoid relative slippage movement between roll 30 and the sliver, because there would then be an insufficient number of gripping edges 44 in contact with sliver 22 at any time interval available to securely snub the sliver. This would result in the undesired relative movement above mentioned, with attendant scuffing and possible degradation of the sliver. If the roll 30 were at too high an elevation, again the consequences would be the same as for a roll of insufficient diameter, and no sliver separation would occur.

if the roll 30 were at too low an elevation, the roll would act as a barrier to the moving sliver 22, which latter would be forced into the space between the plate and the roll rather than under roll 30. This would cause disruption of the sliver coils and not effect parting of the terminal portion 22' of sliver 22 extending from can 24 to the coiler.

The same or similar undesirable consequences might ensue if roll 30 were laterally positioned so distant from terminal edge 14' of coiler plate 14 as to allow sliver 22 to project upwardly to an elevation significantly above that of the axis of the roll prior to the sliver's initial engagement with the roll's periphery.

While excessive lateral spacing between roll 30 and edge 14' of coiler plate 14 would produce the undesired result indicated above, the heretofore described provision of a limited amount of space (beyond that necessary for mere clearance) between such components is preferred. Such spacing permits sliver 22 to project upwardly, to a limited extent and during movement of can 24 beneath roll 30, into engagement with a portion of the roll's periphery which would not otherwise be engaged by sliver 22 if roll 30 were positioned more closely adjacent edge 14' of plate 14. It therefore indirectly increases the contact area or "wrap angle" (see FIG. 4) present between sliver 22 and roll 30 during movement of can 24 beneath the roll. Such result is a desired and beneficial one.

After normal operation of apparatus 10 is interrupted preparatory to a can changing operation, the terminal portion of sliver strand 22 extending between coiler head 16 and the upper surface of the mass of sliver 22 within can 24 is fixedly held adjacent its coiler-head end by then-stopped feed rolls 20 (FIG. 2). Initial movement of can 24 away from coiler head 16 may cause some additional length of sliver 22 to be withdrawn or "paid out" from the can. This may occur, to a greater or lesser extent depending upon the rotative positions occupied by can 24 and/or by the delivery end of tube assembly (not shown) of coiler head 16 when normal operation of apparatus 10 was interrupted, since the frictional and compressive forces exerted upon such strand by the smooth undersurface of coiler plate 14 are insufficient to prevent such occurrence. However, at some point during the passage of sliver can 24 beneath roll 30, the aforesaid terminal portion of sliver strand 22, which is designated in FIG. 4 by the numeral 22', will necessarily be engaged by main body portion 32 of roll 30. This imposes a compressive force of increased magnitude upon strand 22'. Additionally, the previously-described fluting upon main body portion 32 of roll 30 then exerts a snubbing action upon sliver strand 22'. The combined compressive and snubbing forces imposed by roll 30 upon strand 22 constrain its further withdrawal and cause the strand to thereafter move in unison with the mass of sliver 22 and the sliver can 24 therebeneath. The efficacy of the aforesaid snubbing effect is due in significant part to the fluting upon roll body 32 permitting a substantial "blossoming"to or expansion into the spaces between adjacent lands 36 of those segments of sliver strand 22' intermediate the adjacent strand segments engaged by such lands. Also contributing significantly to the aforesaid snubbing effect is the previously-described angulation between each land 36 and its adjacent slopes 40. The aforesaid engagement between roll 30 and sliver strand 22', and the constraining effect exerted by the former upon the latter, continue until sliver can 24 has moved completely beyond roll 30, although of course the locations of such engagement relative the underlying sliver change due to the roll's rotation and the can's movement producing a rolling nip on the sliver. Once strand 22' is engaged by roll 30, therefore, the continued movement of can 24 from its solid-line and to its phantom-line position of FIG. 1 imposes an attenuating force-upon the strand. Consequently, such continued can movement causes strand 22' to separate or rupture intermediate its length, at some point between roll 30 and feed rolls 20 of coiler head 16. Such result reliably ensues even when sliver 22 is comprised of relatively long and "slippery" synthetic staple fibers. Moreover, and even when the sliver 22 is comprised of relatively short staple cotton fiber, roll 30 does not abrade or otherwise degrade the sliver or significantly disarrange the coiled array thereof within and above can 24, and there is little or no tendency for the fibers to adhere to the roll.

As previously noted, roll 30 normally remains in its lowermost position described above and illustrated in FIGS. 1 and 3. If during movement of sliver can 24 an inexperienced operator should grasp the upper edge of the can, or if a particular can should be of an abnormally greater height, roll 30 would be engaged by the hand of the operator or by the upper edge of the can, as the case might be. In either event, the serious injury or damage which might otherwise result from such engagement is prevented since, in response thereto, roll 30 merely moves laterally upwardly and outwardly as permitted by slots 50 of the brackets 46, 46' which receive the roll gudgeons 34, 34'. Upon cessation of the extraneous elevating force imposed upon roll 30, the roll of course again descends by gravity to its position shown in FIGS. 1 and 3.

In lieu of or in addition to the above-described dead or gravity-weighting of roll 30, weighting means employing springs or a pressurized fluid cylinder might be employed in association with roll 30 if desired.

While a preferred embodiment of the invention has been specifically shown and described, this was for purposes of illustration only, and not for purposes of limitation, the scope of the invention being in accordance with the following claims.

That which is claimed is:

1. In a textile sliver coiler apparatus having a frame; a coiler head carried by said frame for, during normal operation of said apparatus, delivering a strand of sliver coiled into a sliver can then disposed beneath said coiler head; said strand, after filling of said sliver can and during movement thereof from said apparatus, being fixedly held at said coiler head and extending therefrom to the upper surface of a mass of coiled sliver previously delivered into and then extending resiliently upwardly from said sliver can; and can changing means for, during movement of said sliver can from said apparatus, moving said sliver can away from said coiler head along a predetermined path of travel; the improvement comprising:

sliver separating means for constraining withdrawal of said sliver strand from said sliver mass during movement of said sliver can along said path of travel thereof, and for thereby causing attenuation and separation of strand during and in response to said movement of said sliver can;

said sliver separating means including a roll member; and mounting means mounting said roll member closely above said path of travel of said sliver can for engagement of said roll with said sliver mass and with said sliver strand during said movement of said sliver can along said path of travel thereof, and for free rotation of said roll about its central axis under the impetus of said engagement and said movement;

said roll imposing a compressive force upon said sliver strand during its said engagement therewith, and said roll having fluting means thereon for also then imposing upon said strand a snubbing force acting in conjunction with said compressive force and can movement to constrain, attenuate and part said strand.

2. Apparatus as in claim 1, wherein said mounting means mounts said roll upon said frame of said apparatus in transversly extending relationship to said path of travel of said sliver can, and wherein the length of said roll at least equals the diameter of said can.

3. Apparatus as in claim 1, wherein said mounting means also mounts said roll for movement between a lowered operative position normally occupied by said roll, and a raised inoperative position.

4. Apparatus as in claim 3, wherein said mounting means comprises a pair of horizontally spaced bracket members carried by said frame of said apparatus and having slots therein extending laterally upwardly and outwardly from said frame, and wherein said roll includes gudgeons at opposite ends thereof received within and movable along adjacent ones of said bracket slots.

5. Apparatus as in claim 1, wherein said fluting means extends generally longitudinally of said roll and defines a plurality of alternating lands and valleys and interconnecting slopes, and wherein the included angles defined between said lands and adjacent ones of said slopes each having a magnitude of at most 90°.

6. Apparatus as in claim 5, wherein the edges defined by the intersections of said lands and said adjacent slopes each have a radius of curvature within the range of 0.005 to 0.02 inches (0.0127 to 0.0508 centimeters).

7. Apparatus as in claim 5, wherein said land and said valleys and said slopes are substantially smoothly surfaced.

8. Apparatus as in claim 5, wherein the ratio of the area of said lands to the projected area of the spaces between said lands is at most 1 to 1.

9. Apparatus as in claim 8, wherein said ratio is at most approximately 1 to 2.

10. Apparatus as in claim 5, wherein said roll has an outer diameter of approximately 2 inches (5.08 centimeters), and wherein said valleys each have a depth of at least 0.10 inch (0.254 centimeter).

11. Apparatus as in claim 1, wherein said frame of said apparatus includes a coiler plate extending generally horizontally in overlying relationship to a part of said path of travel of said sliver can, and wherein said roll is mounted by said mounting means in spaced adjacent relationship to a terminal edge of said coiler plate sufficient for said flutes to engage said sliver with said snubbing force, with the central axis of said roll disposed at an elevation at least as high as that of the undersurface plane of said coiler plate.

12. Apparatus as in claim 11, wherein a peripheral portion of said roll projects below said undersurface plane of said coiler plate.

13. Apparatus as in claim 11, wherein said mounting means also mounts said roll for movement between a lowered position wherein a peripheral portion of said roll projects below said undersurface plane of said coiler plate, and a raised position wherein said roll is disposed entirely above said plane.

* * * * *